United States Patent [19]

Rooklyn

[11] 4,227,466

[45] Oct. 14, 1980

[54] IN-DEPTH STORAGE DEVICE

[75] Inventor: Jack Rooklyn, Northridge, Calif.

[73] Assignee: Industrial Management Co., Beverly Hills, Calif.

[21] Appl. No.: 929,283

[22] Filed: Jul. 31, 1978

Related U.S. Application Data

[63] Continuation of Ser. No. 815,946, Jul. 15, 1977, abandoned.

[51] Int. Cl.[2] ..... A47B 57/00

[52] U.S. Cl. ..... 108/93; 108/102; 211/151; 211/162

[58] Field of Search ..... 108/93, 102, 108, 143; 211/162, 151; 312/342, 344, 286, 311; 248/430

[56] References Cited

U.S. PATENT DOCUMENTS

| | | | |
|---|---|---|---|
| 880,827 | 3/1908 | Resler | 211/151 |
| 947,583 | 1/1910 | Smith et al. | 108/108 |
| 1,315,922 | 9/1919 | Franklin | 108/143 |
| 1,617,685 | 2/1927 | Levene | 108/108 |
| 1,870,763 | 8/1932 | Znidersic | 312/344 |
| 1,946,789 | 2/1934 | Giesemann | 312/342 |
| 2,946,458 | 7/1960 | DuBoff et al. | 211/162 X |
| 3,016,150 | 1/1962 | Lake | 108/102 |
| 3,446,545 | 5/1969 | Horlacher | 312/311 |
| 3,465,894 | 9/1969 | Setecka | 211/151 |
| 3,945,510 | 3/1976 | Saul et al. | 211/162 |
| 4,030,609 | 6/1977 | Liebetrau et al. | 211/162 |

*Primary Examiner*—Francis K. Zugel
*Attorney, Agent, or Firm*—Herzig & Walsh, Incorporated

[57] ABSTRACT

An in-depth storage device where fixed shelves are supported on a plurality of vertical uprights and a sliding shelf is used in conjunction with each of the fixed shelves to provide in-depth storage space. The sliding shelves may be moved either manually or by powered mechanical means horizontally so as to align the leading edge of the sliding shelves with the leading edge of the fixed shelves. The track means upon which the sliding shelf is movable consists of a pair of channel beam members forming a simple beam connection between the fixed shelf members. Each channel beam carries a plurality of rollers which are mounted to the vertical flange of the channel beam within the channel portion of said beam. The sliding shelves are supported by an I beam, the lower flange of which engages the rollers which are mounted within the channel beams. Roller means is also provided within the channel beam members for articulation with the vertical flange of the I-beam supporting the sliding shelves thereby providing lateral stability therefor. The sliding shelves are spaced directly above the fixed shelves and when the sliding shelf and fixed shelf are aligned, the sliding shelf may be loaded with merchandise and then moved horizontally and rearwardly so as to expose the fixed shelf which is then loaded with merchandise.

5 Claims, 4 Drawing Figures

2
10
39
37
9
7
19
25
23
58
42
5
33
30
3
35
2
15
21
44
1
24
46
17
52
50
20
54
6
13
60
58
4
11
2

37
9
63
58
61
70
75
67
77
72
73
69
23
71
25
57
53
43
47
41
59
45
49
55
60
51
24
27
31
29
19
22

IN-DEPTH STORAGE DEVICE

This is a continuation of application Ser. No. 815,946 filed on 7/15/77, now abandoned.

BACKGROUND OF THE INVENTION

1. Field of the Invention

This invention relates to a warehousing storage device which provides in-depth storage utilizing sliding and fixed shelves. The sliding shelf is positioned over the fixed shelf and loaded with merchandise and thereafter said sliding shelf is moved into a storage position exposing the fixed shelf which can thereafter also be loaded with merchandise.

2. Description of the Prior Art

Merchandise storage upon pallet racks is a common warehousing technique used so as to utilize available warehousing space more efficiently and to facilitate movements of quanities of merchandise transported in protable containers. Where the merchandise or containers is to be deeply stored on a shelf or rack, the depth of storage may be limited by the operational range of warehousing machinery and also the inherent physical limitations of individuals involved in manually loading merchandise or containers on shelves where deep storage on the shelf is desired. These deficiencies are overcome by the herein as described in detail hereinafter.

BRIEF SUMMARY OF THE INVENTION

In accordance with this invention, a plurality of fixed shelves are held by vertical support members in a rigid, horizontal position. A plurality of sliding shelves are provided in spaced relationship with said fixed shelves such that the leading edge of the sliding shelves may be aligned with the leading edge of the fixed shelves. A track means is provided upon which the sliding shelves articulate and consists of interfacing channel beams which form a simple beam connection, or bridge, between the fixed shelf members. On the vertical flanges of the channel beams, an upper and lower train of rollers are oppositely mounted which engage the lower flange of an I-beam member, thereby forming a friction rolling train within which the lower flange of the I-beam articulates. The upper horizontal flanges of the channel beam members also carry a train of oppositely mounted rollers where the axis of said roller is located in a vertical plane. The aforesaid rollers engage the central vertical flange of the I-beam member thereby providing lateral and directional stability for the I-beam member during motion with respect to the roller trains. The upper flange of the I-beam member forms the support platform for the sliding shelf which is rigidly fastened to said I-beam thereby forming an integral combination for relative movement with respect to the fixed shelf.

It is an object of the present invention to provide a device utilizing sliding shelves in conjunction with fixed shelves for in-depth storage of merchandise.

It is a further object of this invention to provide a sliding shelf which is supported by a plurality of pairs of channel beams interconnecting fixed shelves, where the leading edge of the sliding shelf member may be aligned with the leading edge of the fixed shelf member during loading phases, and thereafter the sliding shelf is moved into an in-depth position exposing the fixed shelf member for further loading.

It is also an object of this invention to provide an in-depth storage device for efficient utilization of warehousing space.

It is a still a further object of this invention to provide a storage device by which modern warehousing machinery may be conveniently utilized for in-depth storage of merchandise on standard or cantilever racks.

Further objects and additional advantages of the invention will become apparent in the following detailed description and annexed drawings.

DETAILED DESCRIPTION OF THE PREFERRED EMBODIMENTS

Figure 1:
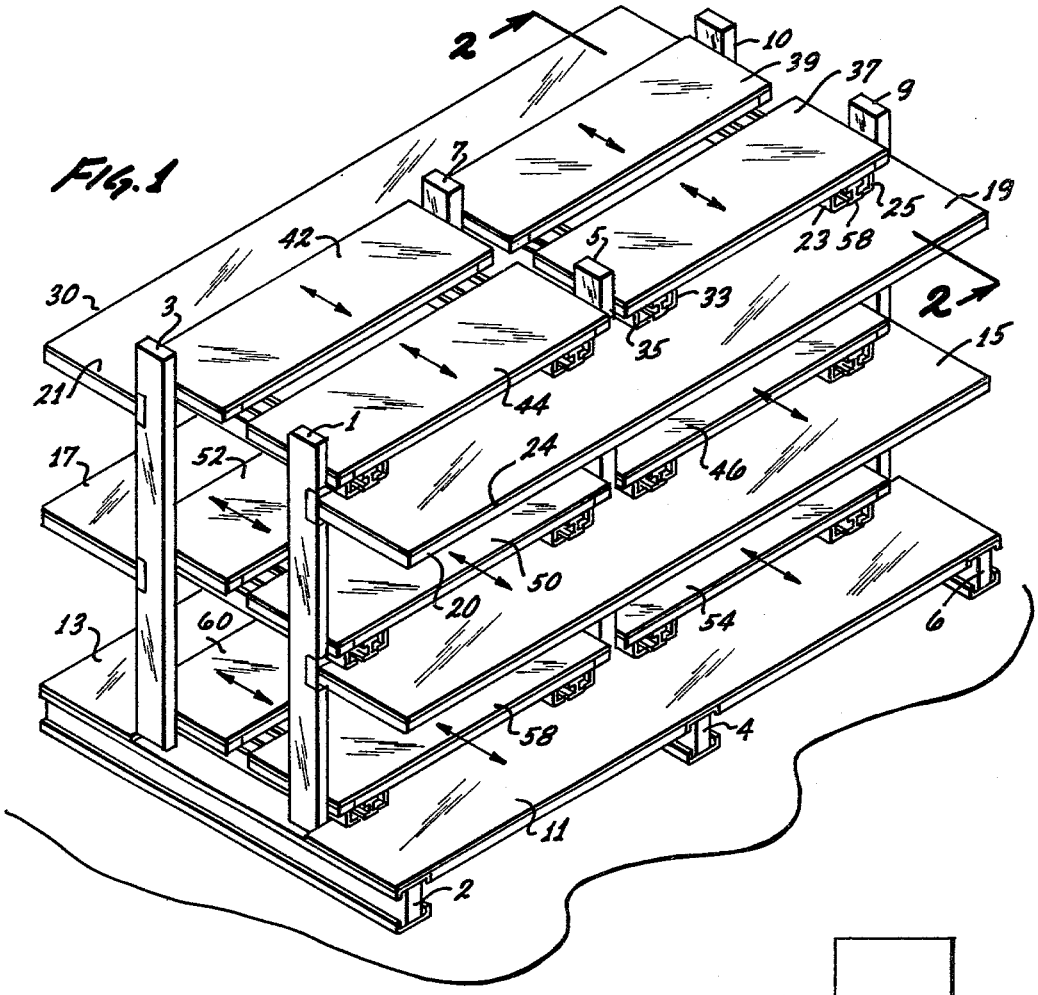
FIG. 1 is an isometric view of the in-depth storage device.

Turning now to FIG. 1, the in-depth storage device is illustrated in a preferred configuration. As can be seen on FIG. 1, the structure is symmetrical. Vertical support members 1 and 3 are mounted rigidly to base beam 2 by suitable means. Similarly, vertical support members 5 and 7 are rigidly attached to base beam 4 by suitable means. In the same manner, base beam 6 is also utilized to form the base structure for the device. Extending from base beam 6 are vertical support members 9 and 10 rigidly fastened to base beam 6 thereby completing the shelf structure of the in-depth storage device. Vertical support members 1, 3, 5, 7, 9 and 10 are symmetrically positioned on the respective base beams supporting said vertical members in an in-line fashion along the horizontal axis of each respective base beam. As can be seen on FIG. 1, vertical support members 1, 5 and 9 are transversely aligned as are vertical support members 3, 7 and 10 in the preferred embodiment of this invention. Base members 2, 4 and 6 may be dimensionally equivalent of each other and contructed of material having identical properties. Similarly, vertical support members 1, 3, 5, 7, 9 and 10 may also be dimensionally rquivalent and of the same construction where any one of said vertical support members is structurally interchangeable with any of the others.

Horizontal shelf 11 is of a rectangular shape and is fixed by appropriate means to base beam members 2, 4 and 6, and extends in width to vertical support members 1, 5 and 9, thereby forming a horizontal continuous fixed shelf platform interconnecting said base beams of the in-depth storage device. Horizontal shelf 13 which is symmetrically located on the opposite side of the in-depth storage device and which is identical in construction and design to horizontal shelf 11, extends in width to vertical support members 3, 7 and 10, and also forms a continuous horizontal shelf platform extending across base beam members 2, 4 and 6.

Referring again to FIG. 1, the invention in its preferred form has in addition to fixed shelves 11 and 13, a plurality of horizontal shelves, namely 15, 17, 19 and 21, which are all dimensionally equivalent to horizontal shelves 11 and 13, and are also of similar construction. A cross-sectional view of horizontal shelves 19 and 21 is referred to for a more particular description of the construction of the horizontal shelves on FIG. 2 of the drawings, it can be seen that shelf 19 has sidewalls 20 and 22, with a cover plate 24, forming the support platform for horizontal shelf 19. As can also be seen in FIG. 2, horizontal shelf 21 is of similar construction to horizontal shelf 19, said horizontal shelf 21 having sidewalls 26 and 28, and a cover plate 30 forming the support platform for horizontal shelf 21. Horizontal shelves 11, 13, 15 and 17 are equivalent both in dimensions and construction to horizontal shelves 19 and 21.

Figure 2:
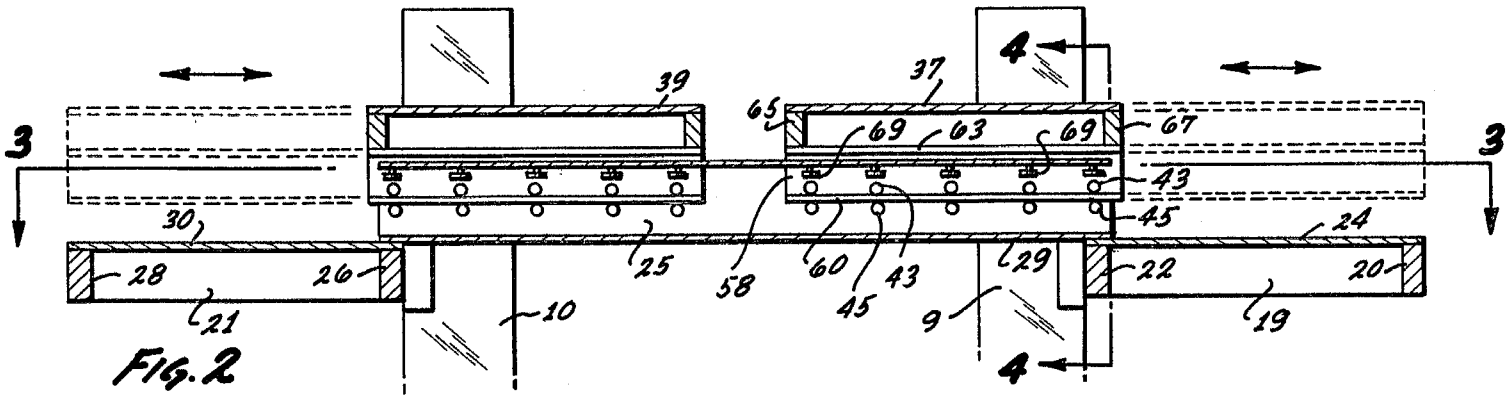
FIG. 2 is a sectional view, taken along the line 2—2, FIG. 1.

Referring again to FIG. 2, the manner in which the plurality of horizontal shelves are mounted to the vertical support members of the in-depth storage device is more particularly illustrated. As can be seen in FIG. 2, horizontal shelves 19 and 21 are connected to vertical support members 9 and 10 by suitable connecting means such that horizontal shelves 19 and 21 form a cantilever support platform where the fixed end of the cantilever platform is carried by the vertical support member.

An intermediate tier of shelves is provided by horizontal shelf members 15 and 17 shown on FIG. 1. Horizontal shelf members 15 and 17 are mounted in a cantilever fashion to the vertical support members in the same manner as previously described for horizontal shelves 19 and 21.

Figure 3:
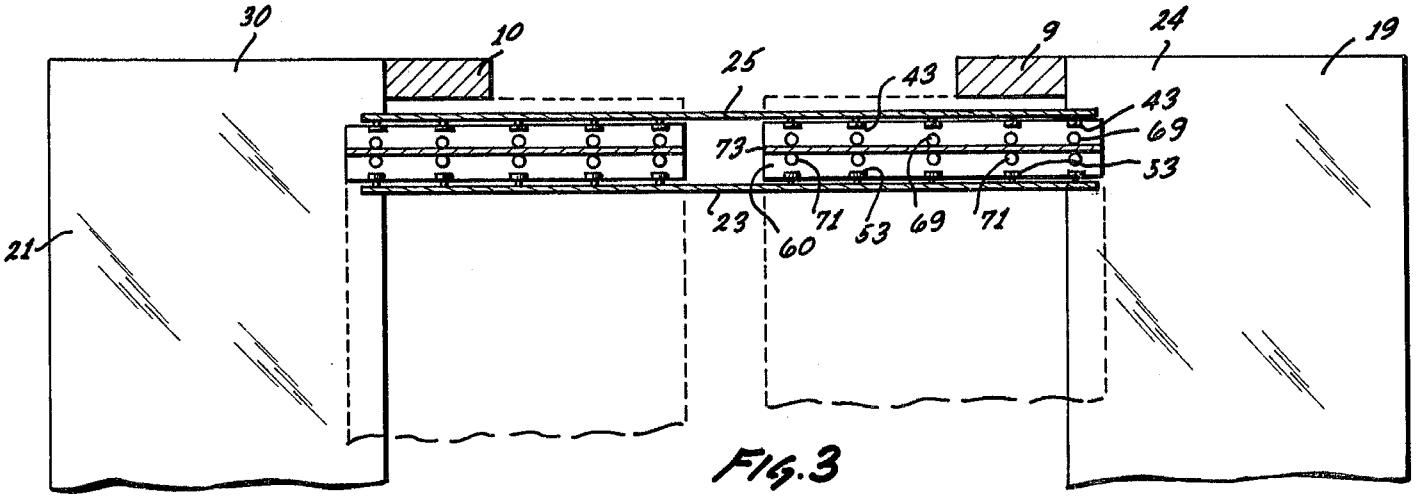
FIG. 3 is a sectional view, taken along the line 3—3, of FIG. 2.

Referring to FIG. 3, channel beam members 23 and 25 interconnect horizontal shelf members 19 and 21 where said channel beam members rigidly adhere to cover plates 24 and 30 of respective horizontal shelf members 19 and 21, forming a fixed bea therebetween.

Figure 4:
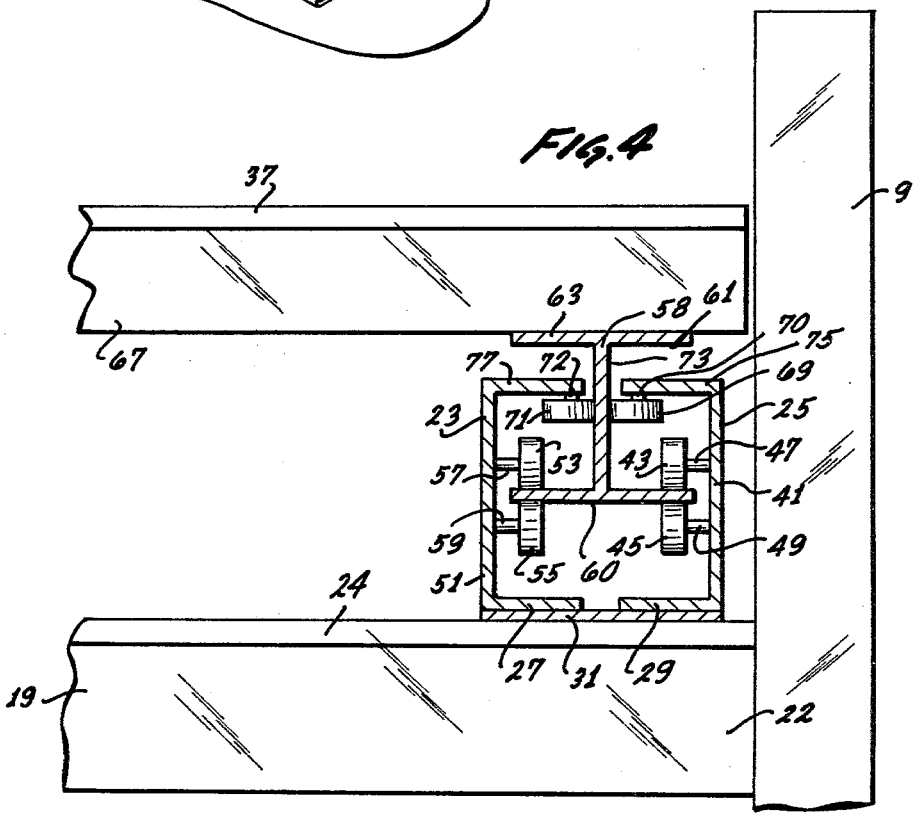
FIG. 4 is a sectional view, taken along the line 4—4, of FIG. 2.

By reference to FIG. 4, it can be seen that channel beam members 23 and 25 interface each other, forming an approximate box beam, with lower flanges 27 and 29 rigidly adhering to mounting pad 31 which, in turn, attaches to cover plate 24 by suitable attachment means. A plurality of interfacing channel beam members interconnect the horizontal shelves of the in-storage device as shown on FIG. 1 and are supported in a fixed beam fashion in a manner identical to that previously described for channel beam members 23 and 25.

As can be further seen on FIG. 1 of the drawings, sliding shelves 37 and 39 are slideably mounted to channel members 23, 25, 33 and 35. The mechanism by which said sliding shelf members are permitted to move horizontally is more particularly shown in FIG. 4. A description of the sliding mechanism as shown in FIG. 4 is intended to be descriptive of the sliding mechanism as used throughout the in-depth storage device; therefore, although the sliding mechanism is contained within channel members 23 and 25 only, as shown in the drawings, the description thereof may be incorporated as typical for the sliding mechanism used throughout the entire structure.

Referring now to FIG. 2, a train of oppositely mounted rollers, rollers 43 and 45 being typical of each roller contained within said train, is shown where the lower flange 60 of I-beam 58 passes between the train of rollers which have their centers of rotation aligned on a horizontal axis. As can more particularly be seen in FIG. 4, roller 43 is rotatably mounted to axle 47 which is carried by vertical flange 41 of channel beam 25. Similarly, roller 45 is rotatably mounted to axle 49 which is also carried by vertical flange 41 of channel beam 25. As was previously mentioned, and shown on FIG. 2, the plurality of rollers carried by channnel member 25 are structurally mounted so as to be in horizontal alignment with rollers 43 and 45 for engagement with lower flange 60 of I-beam member 58.

A train of rollers is also provided within the channel section of channel beam member 23. Referring to FIG. 4, it can be seen that rollers 53 and 55 are rotatably connected to axles 57 a 59, respectively, where said axle members are in vertical alignment. In summary, therefore, lower flange 60 of I-beam member 58 is supported and articulates with a train of oppositely mounted rollers engaging both the upper and lower surfaces of said lower flange, thereby permitting horizontal motion of said I-beam relative to the channel beam members forming a support therefor.

Lateral stability of I beam member 58 is accomplished through the use of a plurality of rollers which are symmetrically positioned as more particularly shown in FIG. 3. As can be seen in FIG. 3, vertical flange 73 of I beam 58 passes between oppositely mounted rollers typified by rollers 69 and 71 where the centers of rotation of said rollers lie in the same horizontal plane and are laterally aligned within the said plane. The rollers comprising the train of rollers as herein described may have a suitable surface for frictional engagement with vertical flange 73 of I beam 58. Reference is again made to FIG. 4 to demonstrate more particularly the structure by which lateral stability of I beam 58 is accomplished. Axle 70 is securely mounted to the upper flange 75 of channel beam 25 where the axis of said axle is vertical. Roller 69 is rotatably mounted to axle 70 where the periphery of said roller 69 engages central flange 73 of I beam member 58. Similarly, axle 72, also having a vertical axis, is attached to the upper flange 77 of channel beam member 23; roller 71 is rotatably mounted to said axle 72 where the outer periphery of said roller engages the surface of vertical flange 73 of I beam 58.

The upper horizontal flange 63 of I beam member 58 form the support base for sliding shelf 37. Sidewall members 65 and 67 of support shelf 37 rigidly adhere to the upper surface of horizontal flange 63 of I beam member 58 thus completing the shelf structure utilized in the preferred embodiment of this invention. The description applicable to sliding shelf 37 is incorporated to describe the movement and construction of sliding shelves 39, 42, 44, 46, 48 (not shown on the drawings), 50, 52, 54, 56 (not shown on the drawings), 58 and 60.

An alternative embodiment of this invention may include additional vertical support members which would form a simple support for the fixed shelf members. The additional vertical members would thereby strengthen the structure to accommodate higher shelf loading.

It is also an alternative embodiment of this invention to include a means by which the sliding shelves may be horizontally positioned through the use of an external power source.

The invention, therefore, is utilized by the sliding shelves being moved to a forward position where the leading edge thereof is in approximate alignment with the leading edge of the fixed shelf in spacial relationship with said sliding shelf. The sliding shelf is then loaded and thereafter moved horizontally into an in-depth position where movement into said in-depth position exposes the fixed shelf for further lowering.

From the foregoing, those skilled in the art will readily understand the nature of the invention, its construction and operation, and the manner in which it achieves and realizes all of the objects and advantages as set forth in the foregoing as well as its many additional advantages that are apparent from the detailed description.

It is claimed:

1. An improved warehouse storage device for merchandise having a base, a plurality of vertical support members extending upwardly from said base and being horizontally spaced from one another, a plurality of fixed cantilever mounted horizontal storage shelves affixed to said vertical support members and extending outwardly from said vertical support members such that certain of said fixed horizontal storage shelves affixed to successive vertical support members are horizontally spaced from one another, a plurality of sliding shelves movable along horizontal paths in spaced relationship overlying said fixed shelves and separate guide means mounted between said horizontally spaced fixed storage shelves and spanning substantially only the space therebetween for support and horizontal guiding of said sliding shelves outwardly and inwardly relative to said fixed shelves such that said sliding shelves may be moved to overlie said fixed shelves and loaded with merchandise and thereafter horizontally displaced inwardly to a position over the space between said certain shelves to expose substantally the entire area of said fixed shelves for loading with merchandise.

2. The invention as receited in claim 1, wherein said guide means includes: track means attached between said spaced apart horizontal fixed shelves;

roller means affixed to said track means for supporting and directionally guiding horizontal movement of said sliding shelves; and support members engaged with said roller means and fixed to said sliding shelves.

3. The invention as in claim 2, wherein said track means comprises a plurality of interfacing channel beams.

4. The invention as in claim 3, wherein said roller means comprises rollers rotatively mounted to said channel beams.

5. The invention as recited in claim 4, wherein each support member is an I-beam, having a lower flange which engages rollers and a central vertical flange which engages rollers and an upper flange which is attached to a sliding shelf.

* * * * *